US006725861B1

(12) United States Patent
Semeia

(10) Patent No.: US 6,725,861 B1
(45) Date of Patent: Apr. 27, 2004

(54) VALVE FOR UNDERWATER AQUALUNG SUPPLYING DEVICES

(75) Inventor: Roberto Semeia, San Salvatore Di Cogorno (IT)

(73) Assignee: Scubapro Europe S.R.L. (IT)

( * ) Notice: Subject to any disclaimer, the term of this patent is extended or adjusted under 35 U.S.C. 154(b) by 0 days.

(21) Appl. No.: 10/048,611

(22) PCT Filed: Dec. 27, 1999

(86) PCT No.: PCT/EP99/10393

§ 371 (c)(1),
(2), (4) Date: Feb. 4, 2002

(87) PCT Pub. No.: WO01/10709

PCT Pub. Date: Feb. 15, 2001

(30) Foreign Application Priority Data

Aug. 4, 1999 (IT) ..... GE99A0091

(51) Int. Cl.[7] ..... A62B 9/02

(52) U.S. Cl. ..... 128/205.24; 132/81.2; 251/318

(58) Field of Search ..... 128/200.24, 201.27, 128/201.28, 203.11, 204.18, 205.22, 205.24, 207.12, 207.14–207.18; 251/318, 320–330, 336, 900, 281, 282, 213, 205, 175–179, 12; 137/81.2, 301

(56) References Cited

U.S. PATENT DOCUMENTS 3,960,169 A * 6/1976 Orth et al. ..... 137/491
5,190,030 A * 3/1993 Semeia ..... 128/204.26
5,690,100 A * 11/1997 Pomerantz ..... 128/205.24
5,913,236 A * 6/1999 Wodeslavsky ..... 73/40

* cited by examiner

*Primary Examiner*—Glenn K. Dawson
(74) *Attorney, Agent, or Firm*—Stites & Harbison PLLC; Marvin Petry

(57) ABSTRACT

A valve for underwater aqualung supplying devices, including a pressure chamber and a watertight compensation chamber adjacent and watertightly separated by a partition wall. A shutter including a tubular stem inserted, at least in part, inside each chamber. The pressure chamber connected to a pressurized gas source and a housing suitable for cooperating with an end connected with the shutter. The compensation chamber is provided with at least one opening communicating with the outside and a stem end in the shape of an expansion enlarged head connected with the valve outlet. A coil spring is watertightly driven into the chamber between the expansion head and the partition wall. In the valve the enlarged expansion head of the shutter is encircled by a thermal insulating annular part watertightly positioned between the head and the side wall of the compensation chamber.

9 Claims, 1 Drawing Sheet

2
1
R
B
3
101
10
19
72
102
13
12
91
18
16
11
17
93
72
14
131
15
71
7
18
67
8
6
9
92
5

VALVE FOR UNDERWATER AQUALUNG SUPPLYING DEVICES

FILED OF THE INVENTION

The present invention relates to a valve for underwater aqualung supplying devices.

BACKGROUND OF THE INVENTION

The valve of the invention includes:

- a pressure chamber and a watertight compensation chamber, adjacent and watertightly separated by a partition wall,
- a shutter including a tubular stem inserted, at least in part, inside each chamber,
- the pressure chamber being provided with means to connect it to a pressurized gas source and with a housing suitable for cooperating with an end connected with the shutter,
- the compensation chamber being provided with at least one opening communicating with the outside and contains a stem end in the shape of an expansion enlarged head connected with the valve outlet, and
- a coil spring positioned into the compensation chamber between the expansion head and the partition wall,
- the enlarged expansion head of the shutter being encircled by a thermal insulating annular part watertightly positioned between said head and the side wall of the compensation chamber.

A valve of this kind is known from the document EP 0811549 A. In this known valve the thermal insulating annular part is formed by an annular sealing ring on a greater diameter at the shutter's enlarged end head.

In valves of this type, the supplied gas passing through the shutter expands into the expansion enlarged head zone, causing a remarkable cooling of said head and the shutter tubular stem, up to very low temperatures and next to the water freezing temperature. The construction of the known valves allows a thermal exchange between the coil spring and the expansion head and between the shutter tubular stem and the compensation chamber interior. The cooling extends then to the compensation chamber too. In the valves for underwater aqualung supplying devices, in particular in the first stages of the two phase supplying devices, the compensation chamber is filled with water in substantially stable conditions within. The cold transmission, especially from the shutter expansion head, can produce the freezing of the water in the compensation chamber, causing a following inefficiency when not blocking a valve, due to the blocking of the shutter motion.

The goal of the present invention is to provide a valve for underwater aqualung supplying devices to eliminate the disadvantages of the previously described known valves, and where the shutter thermal insulation is improved beside reducing the weight of the same, improving the lubrication within the chamber keeping the mechanical resistance characteristics unchanged.

This goal is achieved by the present invention through a valve for underwater aqualung supplying devices, characterized in that the thermal insulating part covers the expansion head and is positioned between the shutter head and the compensation chamber's side wall through two or more watertight rings.

BRIEF DESCRIPTION OF THE DRAWINGS

The present invention will be better understood through the following description, to be considered as a not limitative description and referring to the only enclosed drawing, FIG. 1, which shows an axial section of an embodiment of the valve according to the present invention with the shutter partially shown in open position and closed position of the valve.

DETAILED DESCRIPTION OF THE PREFERRED EMBODIMENTS

Figure 1:
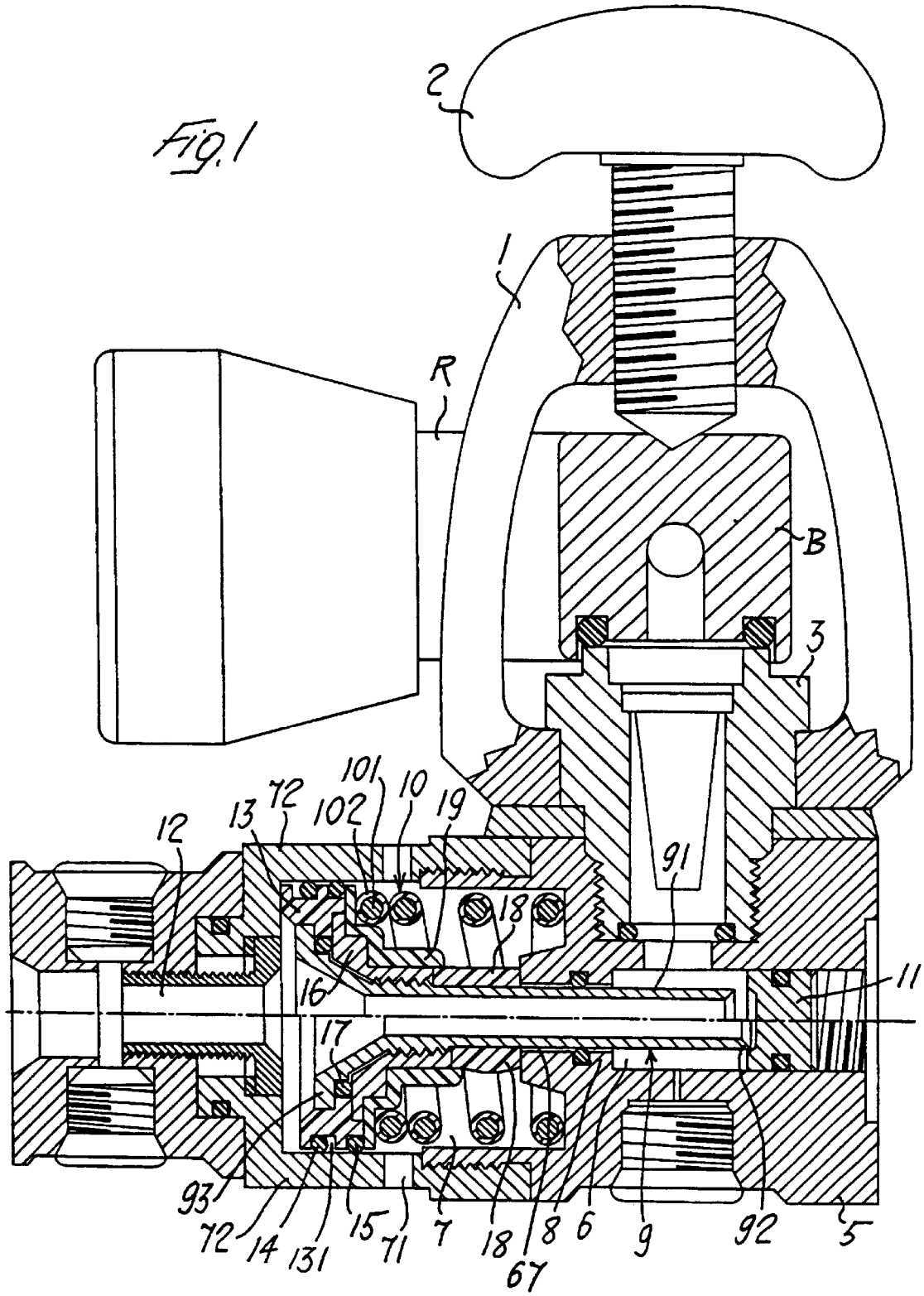

With reference to FIG. 1 the shown valve is the first stage of reduction of the pressure of the air, or a physiological mixture of oxygen and other suitable gasses, of an automatic two stages supplying device for underwater aqualungs. It is joined to the mouth B of a tap R applied on a cylinder (not shown) containing compressed air or an under pressure physiological mixture of oxygen and other gasses. The valve body 5 is joined to the mouth B of the tap R through an inlet tubular union 3 by means of a fastening assembly formed by a bracket 1 and a fastening screw 2 cooperating with said bracket. In the valve body 5 are longitudinally provided two coaxial chambers 6 and 7 which are separated by a partition wall 8, where there is provided a pipe 67 communicating between the two chambers. The first chamber 6, the pressure chamber, communicates with the mouth B of the tap R and the pressurized air or gas mixture is supplied into it; the second chamber, the compensation chamber, communicates with the outside through two openings 71, so that it, during the dive, fills with water at a pressure corresponding to the dive depth. In the pipe 67 is slidingly watertightly housed the tubular stem 91 of a shutter 9, preferably in metal material such as stainless steel to ensure a better resistance both mechanically and chemically (saline, etc.). The shutter 9 projects at one side of the pressure chamber 6 where it ends with a stem end 92 in the shape of a spout. The opposite end of such shutter 9 has an enlarged conical shape, forming an expansion head 93 for the air or gas, watertightly and slidingly driven into the compensation chamber 7. The expansion head 93 communicates with the outlet 12 of the valve provided on the compensation chamber 7 side turned to said expansion head. The spout end 92 cooperates with an housing 11, preferably of non metallic material, so to adjust the outflow of air or gas coming from the tap R mouth B and reaching the pressure chamber 6 and finally, through the shutter 9, the valve outlet 12. The shutter is shown in two positions: from the figure upper part respectively the opening position (with the end 92 separated from the housing 11) and the closing position (with the end 92 close to the housing 11). The compensation chamber 7 is provided with a coil spring 10 interposed between the expansion head 93 and the partition wall 8 between the two chambers 6 and 7. The coils of said spring, in this embodiment form, are formed by a stainless steel core 101 covered by a thermal insulating material layer 102.

As stated above, because of the gas expansion, the compensation chamber 7 is subjected to a great temperature drop which can cause freezing of the water coming from the openings 71. One of the main elements which causes this drop in the temperature is certainly the expansion head 93 which, according to the invention, is covered with a thermal insulating annular part 13. Said part 13 is preferably made of thermal insulating plastic material, which can also include a suitable filling material, such as for instance empty microspheres embedded in the plastic to improve the thermal insulation. The annular part 13 encircling the head 93 has on its outer periphery a first watertight main ring (O-ring) 14 and a second ring 15 completing and improving the thermal insulation besides ensuring a better lubrication since it is useful both for spreading grease or other lubricant in the compartment formed between said rings 14 and 15 and the side wall 72 of the compensation chamber 7, and for preserving the main ring 14 from dirt, sand and other damaging agents. A threaded bushing 16 is provided to hold together the annular part 13 and the enlarged head 93, screwed on a stem length 91, threaded as well, cooperating with said bushing. Moreover a further watertight ring 17 is interposed between the bushing 16 and the shutter head 93. A further feature of the annular part 13 is represented by the fact that the main watertight ring 14 is set in an housing 131 having a width greater than that of the ring itself, so that it is slightly movable relative to the shutter 9 when performing its opening or closing stroke, further improving the lubrication of the parts in motion.

This last said feature of the present invention, apart from the thermal insulating means, is applicable to any plunger or piston of a supplying device of the type described sliding within one or more chambers and provided with one or more watertight rings or bands.

In addiction to the annular part 13 there are provided, for the shutter 9 part within the compensation chamber 7, other thermal insulation means, according to previous patents which show: a sheath 18 on the stem length 91 before the threading, made of compressible thermally insulating material. In fact, when the shutter is in its opening position said sheath is stretched in its natural position, while when the shutter is in a closing position said sheath is compressed; to complete the insulation it is moreover provided with a further bushing 19 of thermal insulating material as well, placed around the threaded bushing 16 and projecting against the annular part 13.

Because of the annular part 13 and, optionally, of the other described insulating means, the cooling of the shutter 9 head 93 caused by the expansion of the air or gas within does not spread to the compensation chamber 7, or to the water or liquid contained within in this manner the water temperature within the compensation chamber 7 is always kept at a value greater than that of the head 93 and finally the shutter 9 is kept above the freezing temperature, at least for the length of time of a normal diving, thus avoiding the inefficiency or the eventual valve blocking an the connected risks for the user.

There are advantages which can be obtained by the valve for a watertight aqualung supplying device according to the embodiments described by way of example, and there are several are the embodiment forms which can be realized to obtain such advantages within the enclosed claims.

What is claimed is:

1. A valve for underwater aqualung supplying devices, including:

a pressure chamber and a watertight compensation chamber, adjacent to the pressure chamber and watertightly separated therefrom by a partition wall, a shutter including a tubular stem inserted, at least in part, inside each chamber, the pressure chamber being provided with means to connect it to a pressurized gas source and having a housing suitable for cooperating with an end of the shutter, the compensation chamber being provided with at least one opening communicating with the outside and containing an end of the stem in the shape of an expansion enlarged head connected with the valve outlet, a coil spring positioned in the compensation chamber between the expansion head and the partition wall, and the enlarged expansion head being encircled by a thermal insulating annular part watertightly positioned between said head and the side wall of the compensation chamber, the thermal insulating part covering the expansion head and positioned between the expansion head and the side wall of the compensation chamber through at least two watertight rings.

2. A valve according to claim 1, wherein the annular part is made of thermal insulating plastic material.

3. A valve according to claim 2, wherein the plastic material of the annular part contains a suitable filling material embedded therein to further improve the thermal insulation.

4. A valve according to claim 3, wherein the filling material comprises hollow microspheres.

5. A valve according to claim 4, wherein the watertight ring positioned in the zone of the head with greater diameter is set in a housing formed so to allow an axial shift of said ring within said housing relative to the axial movement of the shutter.

6. A valve according to claim 1, wherein the shutter stem includes close to the head a threaded length cooperating with a threaded bushing provided with a watertight ring between, the bushing and said shutter head.

7. A valve according to claim 6, wherein the shutter stem includes inside the compensation chamber a thermal insulation sheath axially compressible and positioned between the partition wall and the threaded bushing.

8. A valve according to claim 6, wherein the shutter includes a thermal insulation bushing positioned around the threaded bushing and abutting against the annular part.

9. A valve according to claim 1, wherein the spring coils have a metal core covered with at least one layer of thermal insulating material.

* * * * *